United States Patent [19]

Taylor et al.

[11] 4,171,192

[45] Oct. 16, 1979

[54] ECCENTRIC POSITIONING MEANS FOR A REVERSIBLE PUMP

[75] Inventors: David H. Taylor, Bloomington; Hendrie J. Grant, St. Paul; Lawrence J. Shirek, Minneapolis, all of Minn.

[73] Assignee: Thermo King Corporation, Minneapolis, Minn.

[21] Appl. No.: 903,374

[22] Filed: May 5, 1978

[51] Int. Cl.[2] ..... F04C 1/06; F04C 15/04; F16D 7/02

[52] U.S. Cl. ..... 418/32; 64/30 E; 192/41 R; 192/91 A

[58] Field of Search ..... 418/32, 166, 170, 171; 417/315; 64/30 E; 192/85 AT, 91 A, 41 R

[56] References Cited

U.S. PATENT DOCUMENTS

| | | | |
|---|---|---|---|
| 1,165,772 | 12/1915 | Garrand | 64/30 E |
| 2,151,482 | 3/1939 | Neeson | 418/32 |
| 2,302,110 | 11/1942 | Dow et al. | 64/30 E |
| 2,652,135 | 9/1953 | Flaton | 64/30 E |
| 3,034,447 | 5/1962 | Brundage | 418/171 |
| 3,165,066 | 1/1965 | Phelps et al. | 418/32 |
| 3,303,783 | 2/1967 | Neubauer | 418/32 |
| 3,462,974 | 8/1969 | Riedel et al. | 64/30 E |

FOREIGN PATENT DOCUMENTS

| | | | |
|---|---|---|---|
| 1553281 | 9/1969 | Fed. Rep. of Germany | 418/32 |
| 2055883 | 5/1972 | Fed. Rep. of Germany | 418/32 |

*Primary Examiner*—John J. Vrablik
*Attorney, Agent, or Firm*—F. A. Winans

[57] ABSTRACT

A spring biased member is disposed between the facing surfaces of the reversing eccentric and the rotor of a reversible, unidirectional flow pump. The member is keyed to the eccentric and applies frictional torque to the eccentric from the rotor to drive the eccentric to the proper position as determined by a fixed stop in accordance with the rotor's rotation. The member extends generally tangentially beyond either side of the contact points on the circular rotor face and presents a wedge-shaped confined space to the lubricant on the rotor face. The lubricant is driven into the wedge by the rotating rotor and raises the member from intimate contact with the rotor surface to maintain a thin lubricant film therebetween. This film of lubricant thus separates the member from the rotor face whenever there is relative motion between them to reduce wear on the otherwise contacting parts.

7 Claims, 4 Drawing Figures

ECCENTRIC POSITIONING MEANS FOR A REVERSIBLE PUMP

CROSS REFERENCE TO RELATED APPLICATION

This application is related to copending commonly-assigned application Ser. No. 878,552, filed Feb. 16, 1978 and entitled "Reversible Gerotor Pump". Insofar as the above-identified copending application generally describes a reversible, unidirectional flow gerotor pump, it is herein incorporated by reference.

BACKGROUND OF THE INVENTION

1. Field of the Invention

This invention relates to a reversible, unidirectional flow pump of the type generally referred to as a gerotor pump and more particularly, to a mechanism to effect positive rotation of a normally stationary eccentric ring in response to reversal of the pump rotor.

2. Description of the Prior Art

A reversible gerotor pump is sufficiently described in the above-referenced co-pending application and the prior art disclosed therein is pertinent to the problem of insuring proper orientation of a reversing eccentric in such a pump to maintain a common pump outlet regardless of the direction of rotation of the rotor. However, reference to FIG. 1 herein shows prior art apparatus more analogous to the present invention to positively effect such proper positioning of the eccentric ring. As will be subsequently explained, this prior art shows a spring biased plunger extending outwardly from its cavity in the rotor to frictionally engage the eccentric ring and establish frictional engagement between the ring and the plunger to cause rotation of the ring by the rotation of the rotor. However, once the ring is in proper position, continued rotation of the rotor causes the plunger to continue the frictional engagement of the ring which in turn causes undue wear and frictional drag resulting in premature failure of the apparatus and ultimately the pump.

SUMMARY OF THE INVENTION

The present invention provides a spring biased frictional engagement mechanism for properly orienting the reversing eccentric ring of a unidirectional flow, reversing pump. The mechanism includes a generally "Y" shaped spring interposed between the eccentric ring and the immediately adjacent pump rotor. The leg of the "Y" defines a tab for positive engagement with a notch in the ring and the diverging arms are spring biased against the arcuate face of the rotor. Each arm extends slightly beyond the point of contact to define a confined wedge-shaped space between the cylindrical face of the rotor and the free end of the arm. Thus, when the rotor reverses directon, the spring biased contact between the rotor and the arms will establish a relatively strong frictional engagement therebetween which will tend to drag the spring and ultimately the eccentric ring in the same direction of rotation. However, once the eccentric ring is indexed to the proper position within the pump to provide unidirectional flow, its movement is stopped. Rotation of the rotor, in the presence of a lubricating fluid, will trap a film of lubricant in the confined space, between the arm of the spring and the rotor, forcing a thin lubricating film to raise the arm away from the rotor by the thickness of the lubricating film. This reduces the friction force from the initial engagement between the facing surfaces, to a low level of dynamic fluid shear and separates the components to eliminate wear.

DESCRIPTION OF THE PREFERRED EMBODIMENT

Figure 1:
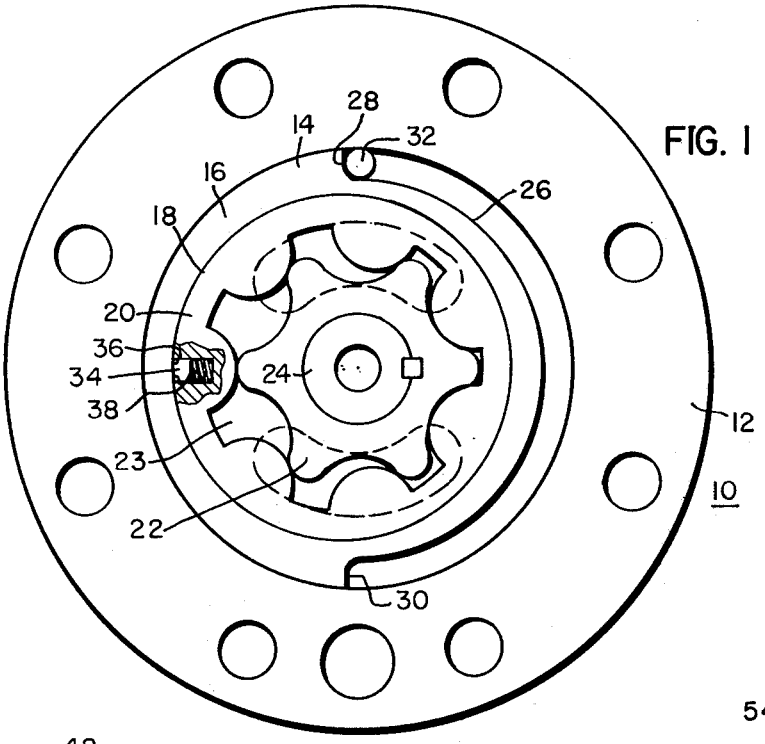
FIG. 1 PRIOR ART
FIG. 1 is a plan view of a prior art friction mechanism for a reversible unidirectional flow pump.

Referring to FIG. 1, the prior art device is shown in a pump 10 which is a well-known reversible pump commonly referred to as a gerotor pump which has a lower housing 12 enclosing, in a central cylindrical cavity 14, the reversing eccentric ring 16 which in turn encloses a gear-set 18 comprising an internally toothed rotor 20 and an externally toothed gear 22. A drive shaft 24 is keyed to the gear 22 to drive it in either direction.

The eccentric ring 16 has an upward facing notch 26 extending arcuately 180° terminating in shoulders 28, 30. A stationary pin 32 extending into the notch from the upper housing member (not shown) limits the rotation of the eccentric ring. Thus, with the rotation of the shaft 24 clockwise, the gear 22 and rotor 20 also rotate clockwise and the friction between the cylindrical face of the rotor 20 and the facing internal cylindrical face of the eccentric, causes the eccentric to rotate clockwise until shoulder 28 and pin 32 abut.

Reversed rotation of the shaft 24 would ideally immediately drive, through the frictional engagement between the parts, the eccentric ring 16 counterclockwise until shoulder 30 abuts pin 32. This change would permit the pump to reverse direction of rotation while maintaining a common discharge outlet therefrom (such as from the upper arcuate chamber 23. However, if the eccentric does not become reoriented with a change in direction of rotation of the rotor, the pump will cease pumping the fluid and, in those instances where it is delivering a lubricant to other machinery, the other machinery can become damaged.

To obtain sufficient friction between the rotor 20 and eccentric ring 16 to position the ring but permit slippage therebetween once the ring is indexed in the proper position by the pin 32, the prior art included a plunger 34 disposed in a cavity 36 in the cylindrical side wall of the rotor 20. A coil spring 38 is also positioned in the cavity to resiliently urge the plunger generally radially outwardly and into frictional engagement with the adjacent face of the eccentric ring 16. However, it is apparent that the plunger 34 is configured and biased to develop sufficient frictional engagement to insure rotation of the eccentric ring and continues to exhibit such frictional contact on the ring even after the ring has been properly positioned and becomes stationary. Thus, the continuous rotation of the rotor causes the plunger and the facing area of the eccentric ring to become unduly worn, resulting in inoperativeness or premature failure of the parts.

Figure 3:
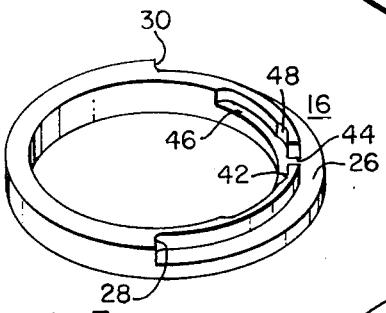
FIG. 3 is an isometric view of the eccentric ring of the pump.
Figure 4:
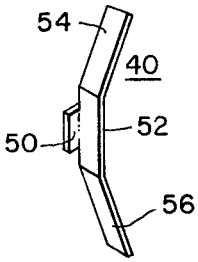
FIG. 4 is an isometric view of the friction member of the present invention.
Figure 2:
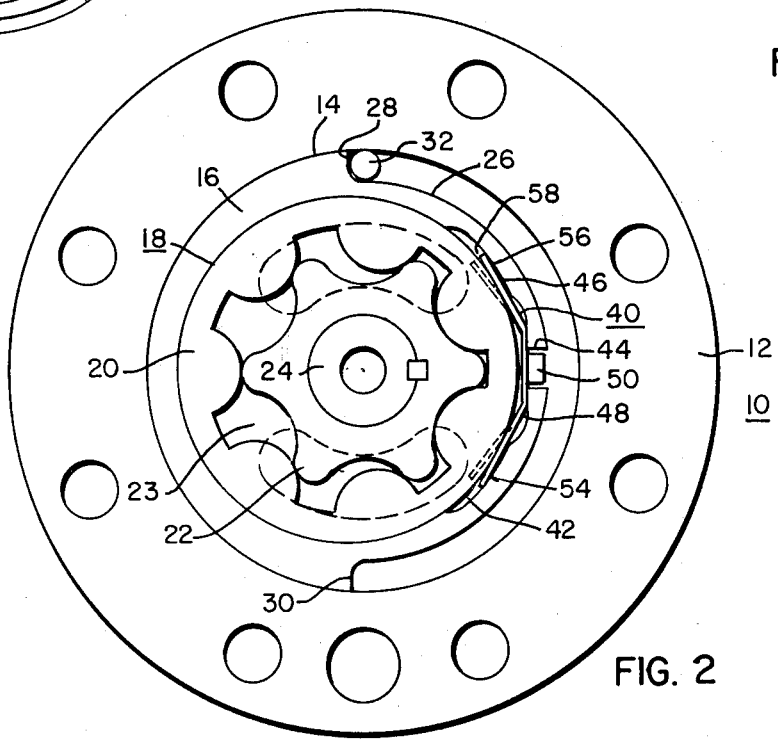
FIG. 2 is a view similar to FIG. 1 of the present invention.

The present invention, as shown in FIGS. 2 through 4, also defines a spring member 40, however, the spring member 40 is essentially in the configuration of a "Y"

and is mounted in the eccentric ring to frictionally engage the cylindrical facing surface of the rotor.

To accommodate the spring member 40, a portion of the inner cylindrical surface of the eccentric is notched as at 42. (See also FIG. 2.) The notch 42 includes a central radially extending portion 44 with arcuate portions 46 adjacent the inner face extending on both sides of the central portion; however, the initial portion 48 of each arcuate portion provides a generally flat surface.

The spring metal member 40 is positioned in the notch 42. The member 40, more clearly seen in FIG. 3, has a generally modified Y-shaped configuration with a leg 50 integrally joined to a cross member 52 extending generally perpendicularly to the leg and with the opposed outer portions 54, 56 on the cross member angled therefrom to form diverging arms.

The member 40 is disposed in the notch 42 such that the leg 50 resides in portion 44 with the cross member 52 abutting the flat initial portions 48 and the diverging arms 54, 56 extending along the arcuate portions 46. However, as shown in dotted line in FIG. 2, the non-deformed position of the diverging arms 54, 56 overlaps the position occupied by the rotor so that, upon becoming deformed to be properly disposed within the notch 42, there is residual spring biasing pressure against the face of the rotor 20. Further, it should be noted that the diverging arms extend 54, 56 on either side of their respective point of contact with the cylindrical face of the rotor. Thus, a wedge shaped space 58 is defined on either side of the point of contact of each arm providing a confined space into which wedge the lubricant is driven by the rotating rotor. This trapped lubricant develops a film on the rotating face of the rotor which causes sufficient separation of the arms from the face, regardless of the direction of rotation of the rotor, to eliminate face-to-face contact between the spring member and the rotor whenever there is relative motion between them and thereby reduces the wear on the parts.

Thus, the arms 54, 56 forcefully abut the facing cylindrical surface of the rotor 20 to insure a large amount of frictional engagement therebetween. This frictional engagement is transmitted through the spring member, which positively engages the eccentric ring through the leg thereof within the notch, so that the ring turns in the direction of the rotor until indexed by the pin 28. Continued rotation of the rotor while the eccentric ring remains stationary causes the lubricant within the pump to be dammed in the confined spaces 58 between each arm and the rotor and allows the lubricant to be wedged between the arms and the rotor, thereby elevating the arms from the rotor to provide full film lubrication therebetween. However, once rotation stops for a reversal of direction, the film of lubricant is essentially squeezed from between the spring arms and the rotor surface to re-establish the frictional engagement necessary to ensure proper orientation of the eccentric ring.

Thus, friction is provided for reversing the position of the eccentric ring 16 for either direction of input rotation and also, the friction forces are removed as soon as the reversing friction is complete by hydrodynamic lubrication which separates the otherwise engaging spring member and rotor.

We claim:

1. Means for frictionally engaging the cylindrical lubricated surface of a rotating cylindrical member and positively drivingly engaging an adjacent annular collar member encircling said cylindrical member to transmit rotation of said cylindrical member to said collar member and wherein said collar member is moved thereby to either one of two positions in response to continuous rotation of the cylindrical member, said means comprising:

at least one generally flat arm resiliently urged into facing engagement with said cylindrical surface adjacent one end and positively retained within said collar member at an opposite end and wherein said one end extends generally tangentially on either side of said engagement to define a pair of opposed wedge-shaped confined spaces between said cylindrical surface and said flat arm whereby lubricating fluid on the surface of said cylindrical member is forced into either of said wedge-shaped spaces, dependent upon the direction of relative rotation between said cylindrical member and said arm, to force a film of lubricant between said arm and said surface to eliminate intimate contact therebetween during the continuous rotation of said cylindrical member.

2. Structure according to claim 1 wherein said means includes a pair of flat arms diverging outwardly from a common end retained within said collar member, with each of said diverging arms extending tangentially on either side of their respective areas of contact with said cylindrical member.

3. Structure according to claim 2 wherein said means is disposed within an appropriately configured notch on the face of said collar member facing said cylindrical surface.

4. In a reversible unidirectional flow fluid pump having a reversing eccentric ring movable between a first and second position in accordance with the direction of rotation of the lubricated pump rotor to maintain outlet flow of the fluid through a common discharge, means for moving said ring to said one position when said pump rotor rotates one direction and moving said ring to said second position when said pump rotor rotates in the opposite direction, said means comprising:

a generally flat arm member resiliently urged into facing engagement with said rotor and extending generally tangentially beyond the point of engagement and positively engaging said eccentric ring whereby the frictional engagement between the arm and said rotor is sufficient to cause said arm and eccentric ring to be driven in a common direction to the desired position and wherein further rotation of said rotor forces lubricant into the space between the tangential extension and said rotor to separate them and reduce wear.

5. Structure according to claim 4 wherein said generally flat arm member comprises a substantially "Y" shaped spring element with each arm thereof resiliently urged into facing engagement with said rotor and the leg thereof received within an appropriate notch in said eccentric ring.

6. Structure according to claim 5 wherein each arm of said "Y" shaped spring engages the arcuate surface of said rotor and extends generally tangentially on both sides of said area of contact to provide a wedge-like space on each side of the area of contact to trap lubricant therein as the rotor continues to rotate forcing the lubricant to form a film between each arm of the "Y" shaped spring and the rotor regardless of the direction of rotation of the rotor.

7. Structure according to claim 6 wherein said ring is notched adjacent said rotor for receipt therein of the extending arms of the "Y" shaped spring.

* * * * *